US010008345B2

(12) United States Patent
Hsu

(10) Patent No.: US 10,008,345 B2
(45) Date of Patent: Jun. 26, 2018

(54) KEYSWITCH

(71) Applicants: DARFON ELECTRONICS (SUZHOU) CO., LTD., Suzhou, Jiangsu Province (CN); DARFON ELECTRONICS CORP., Taoyuan (TW)

(72) Inventor: Chien-Shih Hsu, Taoyuan (TW)

(73) Assignees: DARFON ELECTRONICS (SUZHOU) CO., LTD., Suzhou, Jiangsu Province (CN); DARFON ELECTRONICS CORP., Taoyuan (TW)

( * ) Notice: Subject to any disclaimer, the term of this patent is extended or adjusted under 35 U.S.C. 154(b) by 0 days. days.

(21) Appl. No.: 15/462,929

(22) Filed: Mar. 20, 2017

(65) Prior Publication Data

US 2017/0365423 A1 Dec. 21, 2017

(30) Foreign Application Priority Data

Jun. 16, 2016 (TW) ..... 105118930 A

(51) Int. Cl.
*H01H 13/70* (2006.01)
*H01H 13/52* (2006.01)
*H01H 3/12* (2006.01)

(52) U.S. Cl.
CPC ..... *H01H 13/52* (2013.01); *H01H 3/122* (2013.01); *H01H 2221/04* (2013.01)

(58) Field of Classification Search
CPC .. H01H 13/52; H01H 13/122; H01H 2221/04; H01H 13/7065; H01H 3/125
USPC ..... 200/344
See application file for complete search history.

(56) References Cited

U.S. PATENT DOCUMENTS

| | | | | |
|---|---|---|---|---|
| 8,629,362 | B1 * | 1/2014 | Knighton | H01H 13/52 200/344 |
| 9,343,247 | B2 * | 5/2016 | Hsu | H01H 13/20 |
| 2016/0329174 | A1 * | 11/2016 | Chen | H01H 13/84 |

FOREIGN PATENT DOCUMENTS

| | | | |
|---|---|---|---|
| CN | 101794674 | A | 8/2010 |
| CN | 103165325 | A | 6/2013 |
| TW | M434979 | U1 | 8/2012 |
| TW | 201322293 | A1 | 6/2013 |
| TW | 201608586 | A | 3/2016 |

* cited by examiner

*Primary Examiner* — Edwin A. Leon
*Assistant Examiner* — Lheiren Mae A Caroc
(74) *Attorney, Agent, or Firm* — Winston Hsu

(57) ABSTRACT

A keyswitch includes a board having a first magnetic portion and a pivot portion, a cap, a switch, and a support device including a first support member having first and second bodies connected to each other via an elastic connection arm. The first body has first and second end portions connected to the cap and the pivot portion respectively. The second body has a second magnetic portion and a triggering portion. A U-shaped slot is formed around the triggering portion to make the triggering portion form an elastic cantilever arm extending from the second body. When the cap is pressed to make the second magnetic portion away from the first magnetic portion at a specific distance, the triggering portion triggers the switch. When the cap is released, a magnetic force between the first and second magnetic portions drives the second magnetic portion to approach the first magnetic portion.

22 Claims, 7 Drawing Sheets

KEYSWITCH

BACKGROUND OF THE INVENTION

1. Field of the Invention

The present invention relates to a keyswitch, and more specifically, to a keyswitch utilizing a magnetic attraction force between a support member and a board for driving a cap to return to its original position.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

A conventional keyswitch usually utilizes assembly of a scissor support device and an elastic member to provide a cap with an elastic force for driving the cap return to a non-pressed position. However, since the scissor mechanical design adopted by the scissor support device requires more space so as to further increase the overall height of the keyswitch, it is disadvantageous to the thinning design of the keyswitch. Furthermore, because the elastic member is usually made of rubber material, elastic fatigue of the elastic member may occur after the elastic member is used over a long period of time so as to shorten the life of the keyswitch.

SUMMARY OF THE INVENTION

The present invention provides a keyswitch. The keyswitch includes a board, a cap, a switch, and a support device. The board has a first magnetic portion and at least one pivot portion. The switch is disposed between the board and the cap. The support device is disposed between the board and the cap. The support device includes a first support member. The first support member has a first body and a second body. The first body has a first end portion and a second end portion. The first end portion is movably connected to the cap. The second end portion is movably connected to the at least one pivot portion. The second body has a triggering portion corresponding to the switch and a second magnetic portion corresponding to the first magnetic portion. A U-shaped slot is formed around the triggering portion to make the triggering portion form an elastic cantilever arm extending from the second body toward the board. The first body is integrally connected to the second body via an elastic connection arm. When the cap is not pressed, a magnetic attraction force between the first magnetic portion and the second magnetic portion keeps the cap at a non-pressed position. When the cap is pressed by an external force to make the second magnetic portion separate from the first magnetic portion at a specific distance, the elastic cantilever arm triggers the switch. When the external force is released, the magnetic force drives the second magnetic portion to approach the first magnetic portion, so as to make the cap move back to the non-pressed position with the support device.

The present invention further provides a keyswitch. The keyswitch includes a board, a cap, a switch, and a support device. The board has at least one pivot portion and a first magnetic portion. The at least one pivot portion has two bending sheets arranged alternately with each other. The switch is disposed between the board and the cap. The support device includes a first support member and a second support member. The first support member has a first end portion, a second end portion, a second magnetic portion corresponding to the first magnetic portion and a triggering portion corresponding to the switch. The first end portion is movably connected to the cap. The second end portion has a limiting arm. The limiting arm extends toward the two bending sheets to be inserted between the two bending sheets to make the second end portion rotatably connected to the at least one pivot portion. The second support member has a third end portion, a fourth end portion and an abutting portion. The third end portion is movably connected to the cap. The fourth end portion is movably connected to the board. The abutting portion is located under the second magnetic portion to support the second magnetic portion. When the cap is not pressed, a magnetic attraction force between the first magnetic portion and the second magnetic portion keeps the cap at a non-pressed position. When the cap is pressed by an external force to make the second magnetic portion separate from the first magnetic portion, the triggering portion triggers the switch. When the external force is released, the magnetic force drives the second magnetic portion to approach the first magnetic portion, so as to make the cap move back to the non-pressed position with the support device.

The present invention further provides a keyswitch. The keyswitch includes a board, a cap, a switch, a support device, and returning device. The board has a first pivot portion. The first pivot portion has two first bending sheets arranged alternately with each other. At least one of the two first bending sheets has a planar curved arm. The planar curved arm extends along a planar direction of the board to be connected to the board. The switch is disposed between the board and the cap. The support device includes a first support member. The first support member has a first end portion, a second end portion and a triggering portion corresponding to the switch. The first end portion is movably connected to the cap. The second end portion has a first limiting arm. The first limiting arm extends toward the two first bending sheets to be inserted between the two first bending sheets to make the second end portion rotatably connected to the first pivot portion. The returning device is disposed between the cap and the board for driving the cap to move back to a non-pressed position. When the cap is not pressed, the returning device keeps the cap at a non-pressed position. When the cap is pressed by an external force, the triggering portion triggers the switch. When the external force is released, the returning device drives the cap to move back to the non-pressed position with the support device.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
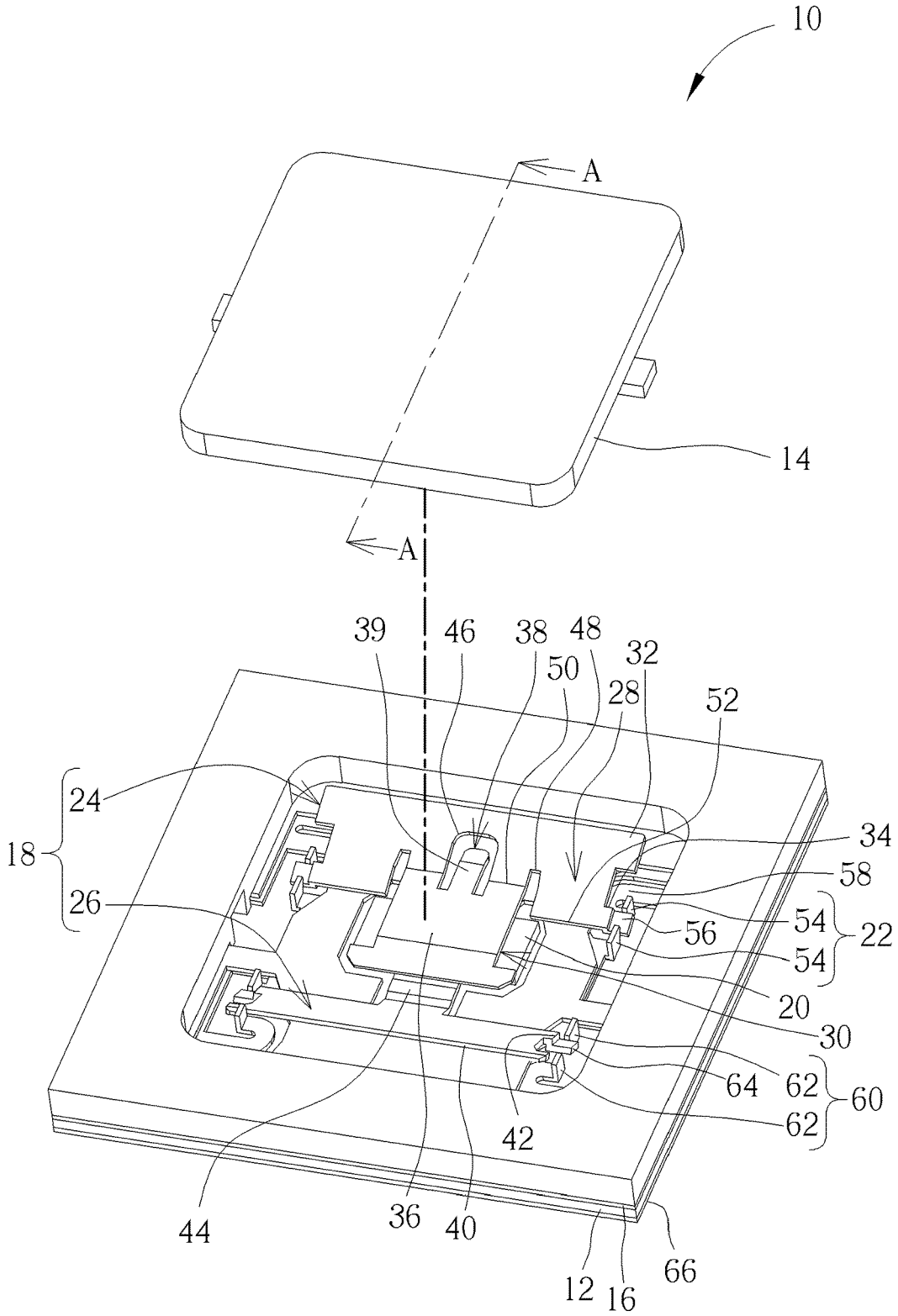
FIG. 1 is a partial assembly diagram of a keyswitch according to an embodiment of the present invention.
Figure 2:
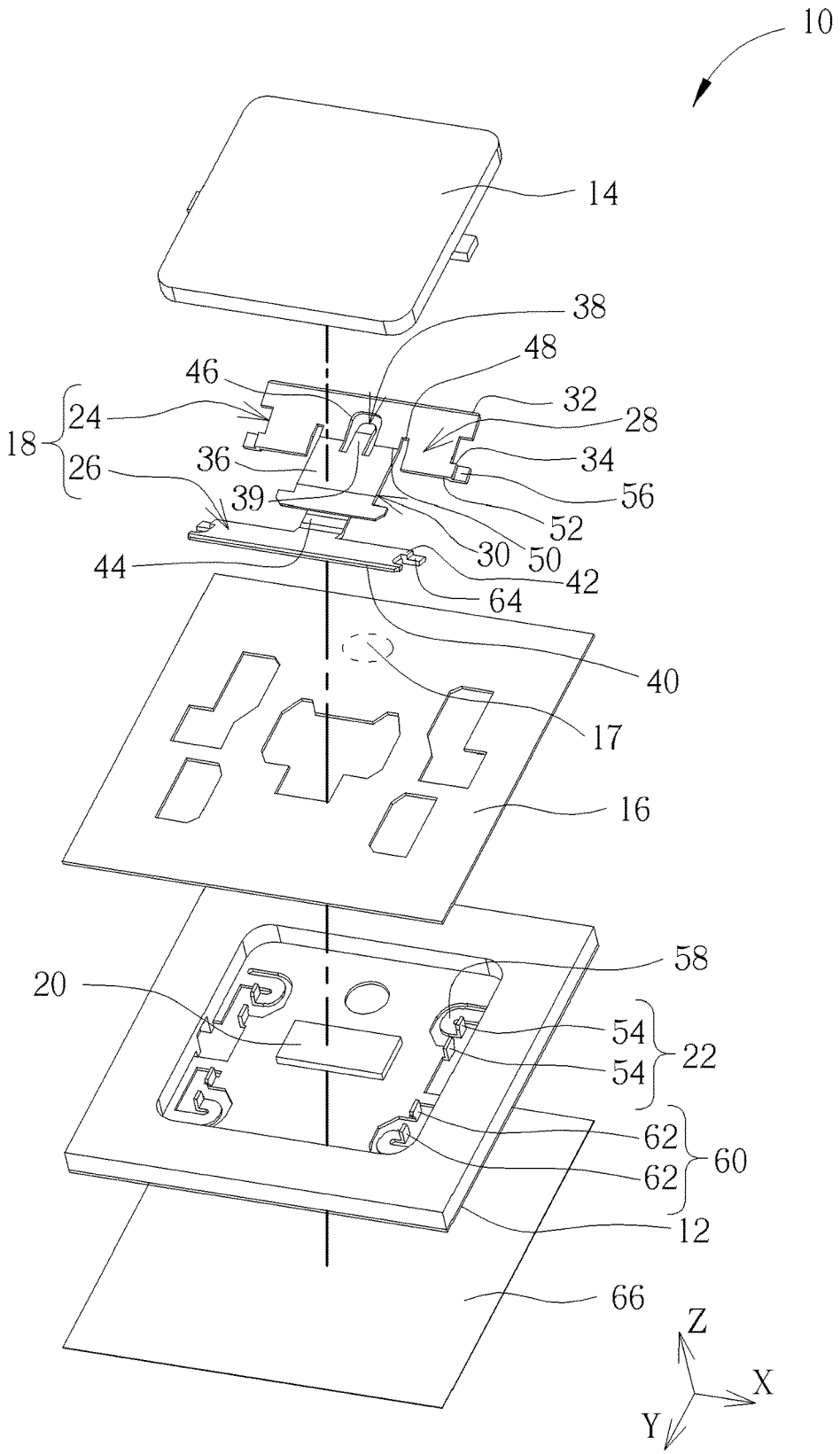
FIG. 2 is an exploded diagram of the keyswitch in FIG. 1.

Please refer to FIG. 1 and FIG. 2. FIG. 1 is a partial assembly diagram of a keyswitch 10 according to an embodiment of the present invention. FIG. 2 is an exploded diagram of the keyswitch 10 in FIG. 1. The keyswitch 10 could preferably be applied to a portable electronic device with a foldable mechanism having an upper cover and a lower casing, such as a notebook or a foldable keyboard device, but not limited thereto. As shown in FIG. 1 and FIG. 2, the keyswitch 10 includes a board 12, a cap 14, a switch 16, and a support device 18. The board 12 has a first magnetic portion 20 and at least one first pivot portion 22 (two corresponding to the first support member 24 as shown in FIG. 1, but not limited thereto). The switch 16 (e.g. a membrane or other triggering switch device) is disposed between the board 12 and the cap 14 and could preferably have a switch unit 17 (e.g. a membrane switch unit) so that the support device 18 could trigger the switch unit 17 for executing a corresponding input function. The support device 18 is disposed between the board 12 and the cap 14 and includes a first support member 24 and a second support member 26. The first support member 24 has a first body 28 and a second body 30. The first body 28 has a first end portion 32 (preferably formed by machining an edge of the first support member 24 to be a round angle structure or an arc surface structure) and a second end portion 34. The first end portion 32 is movably connected to the cap 14. The second end portion 34 is movably connected to the first pivot portion 22. The second body 30 could have a second magnetic portion 36 corresponding to the first magnetic portion 20 and a triggering portion 38 corresponding to the switch 16.

The first magnetic portion 20 could preferably be a magnet, and the second magnetic member 36 could preferably be a magnet or be made of magnetic metal material (e.g. iron or other metal), but not limited thereto. That is to say, in another embodiment, the first magnetic portion 20 could be made of magnetic metal material (e.g. iron or other metal), and the second magnetic portion 36 could be a magnet. The second support member 26 has a third end portion 40 (preferably formed by machining an edge of the second support member 26 to be a round angle structure or an arc surface structure), a fourth end portion 42, and an abutting portion 44. The third end portion 40 is movably connected to the cap 14. The fourth end portion 42 is movably connected to the board 12. The abutting portion 44 is located under the second magnetic portion 36 to support the second magnetic portion 36.

To be more specific, in this embodiment, the second body 30 could have a U-shaped slot 46 formed around the triggering portion 38, so that the triggering portion 38 could form an elastic cantilever arm 39 extending from the second body 30 toward the board 12 to increase the structural elasticity of the triggering portion 38. Furthermore, at least one slot hole 48 (two shown in FIG. 1, but not limited thereto) is formed between the first body 28 and the second body 30 for forming an elastic connection arm 50 located between the slot hole 48 and the U-shaped slot 46. The elastic connection arm 50 bridges the first body 28 and the second body 30 to improve the structural elasticity of the first body 28 relative to the second body 30. Furthermore, the first body 28 could further have an edge portion 52. The edge portion 52 rotatably abuts against the board 12. In other words, via the aforesaid design that the second end portion 34 is movably connected to the first pivot portion 22, the first support portion 24 could take the edge portion 52 as a pivot shaft to rotate relative to the board 12.

The connection design of the first pivot portion 22 of the board 12 and the second end portion 34 of the first body 28 could be as shown in FIG. 1 and FIG. 2. The first pivot portion 22 could include two first bending sheets 54 arranged alternately with each other. A first limiting arm 56 extends from the second end portion 34 toward the two first bending sheets 54 to be inserted between the two first bending sheets 54, so that the second end portion 34 could be rotatably connected to the first pivot portion 22. For further improving assembly convenience of the two first bending sheets 54 and the first limiting arm 56, as shown in FIG. 1 and FIG. 2, at least one of the two first bending sheets 54 (one shown in FIG. 2, but not limited thereto, meaning that the present invention could adopt the design that each first bending sheet 54 has a planar curved arm 58 in another embodiment) could have the planar curved arm 58. The planar curved arm 58 could preferably be U-shaped (but not limited thereto), and could extend along a planar direction (i.e. an XY planar direction as shown in FIG. 2) of the board 12 to be connected to the board 12 to improve the structural elasticity of the first bending sheet 54.

Figure 3:
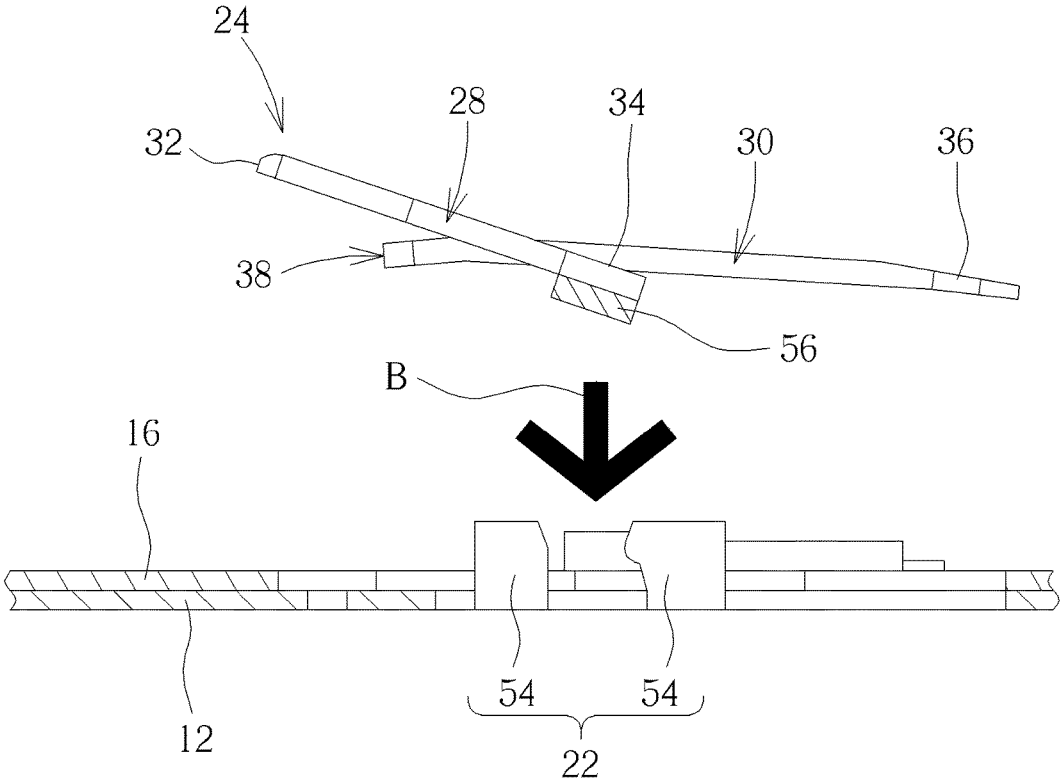
FIG. 3 is a side cross-sectional view that a first support member in FIG. 2 has been not assembled with a board yet.
Figure 4:
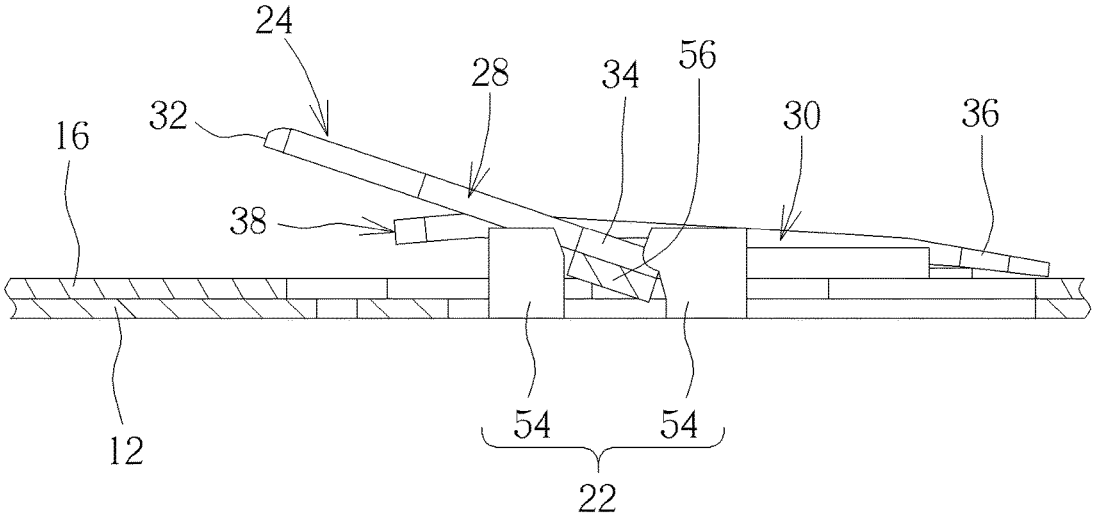
FIG. 4 is a side cross-sectional view that the first support member in FIG. 3 has been assembled with the board.

In such a manner, during the first support member 24 is assembled with the board 12 vertically along an arrow B (as shown in FIG. 3, which is a side cross-sectional view that the first support member 24 in FIG. 2 has been not assembled with the board 12 yet), the first limiting arm 56 could be inserted between the two first bending sheets 54 (as shown in FIG. 4, which is a side cross-sectional view that the first support member 24 in FIG. 3 has been assembled with the board 12) more rapidly and conveniently since the first bending sheet 54 could be deformed elastically due to the elastic characteristic of the planar curved arm 58. Accordingly, the present invention could efficiently prevent the first limiting arm 56 from being jammed with the two first bending sheets 54 due to structural interference between the first limiting arm 56 and the two first bending sheets 54, so as to improve assembly convenience of the keyboard 10.

To be noted, the aforesaid design that the limiting arm is inserted between the two bending sheets could be applied to the second support member 26. In brief, the board 12 could have a second pivot portion 60 and the second pivot portion 60 could have two second bending sheets 62 arranged alternately with each other. The second limiting arm 64 extends from the fourth end portion 42 toward the two second bending sheets 62 to be inserted between the two second bending sheets 62, so that the fourth end portion 42 could be rotatably connected to the second pivot portion 60. As for related description for this embodiment and other derived embodiments (e.g. the second bending sheet 62 could have the planar curved arm 58), it could be reasoned by analogy according to FIG. 1 and FIG. 2 and omitted herein.

In practical application, the first support member 24 and the second support member 26 could preferably be made of magnetic metal material (e.g. iron or other metal). Accordingly, the first support member 24 and the second support member 26 could be magnetized by the magnetic attraction force between the second magnetic portion 36 and the first magnetic portion 20 to make the abutting portion 44 absorbed onto the second magnetic portion 36, so as to ensure that the second support member 26 could move together with the second magnetic portion 36. Furthermore, in this embodiment, the keyswitch 10 could further include a magnetic plate 66. The magnetic plate 66 is disposed under the board 12 (e.g. by a conventional attaching method), to prevent other mechanical or electronic components located under the board 12 from being influenced by the magnetic attraction force between the first magnetic portion 20 and the second magnetic portion 36. To be noted, in another embodiment, the keyswitch 10 could adopt the design that the board 12 could be directly made of magnetic metal material (e.g. iron or other metal) for achieving the aforesaid effect.

Figure 5:
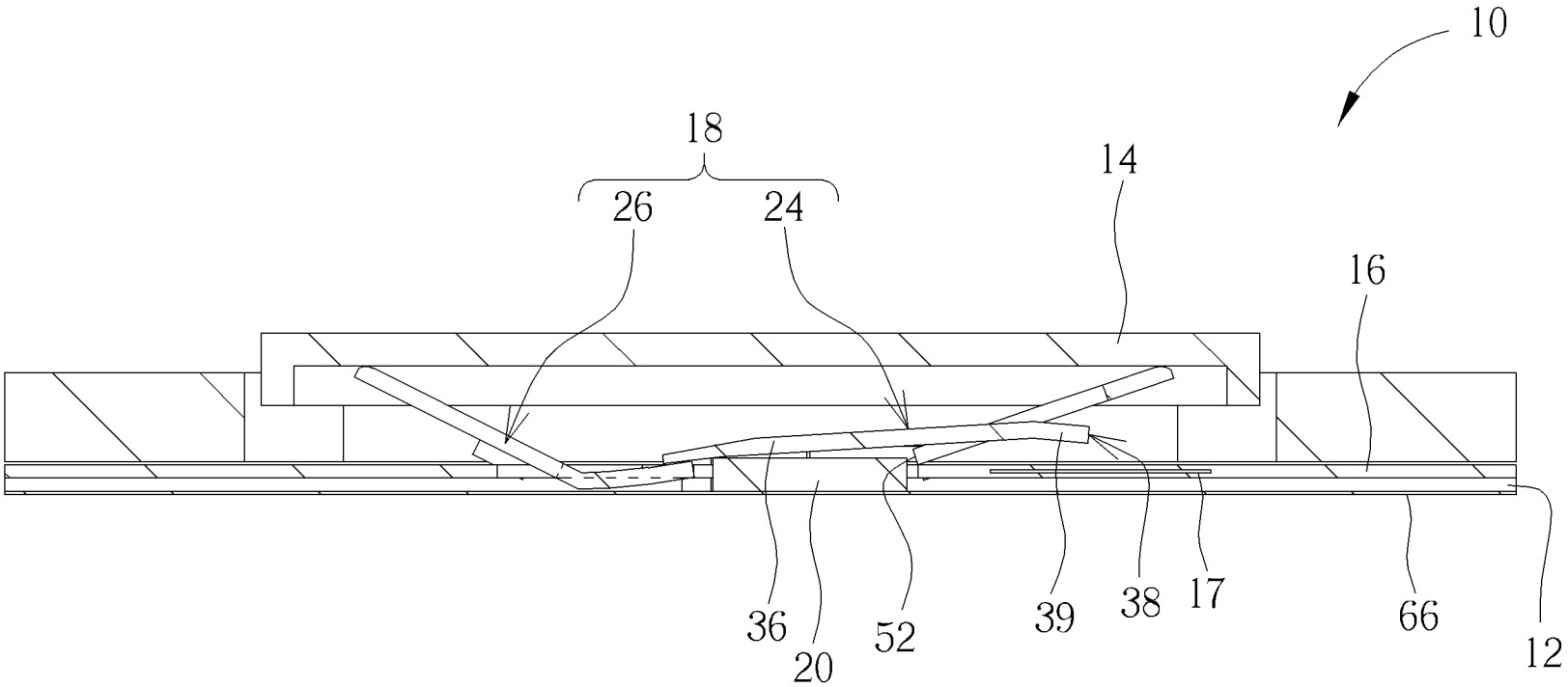
FIG. 5 is a cross-sectional diagram of the keyswitch in FIG. 1 along a cross-sectional line A-A when a cap is assembled with the board.
Figure 6:
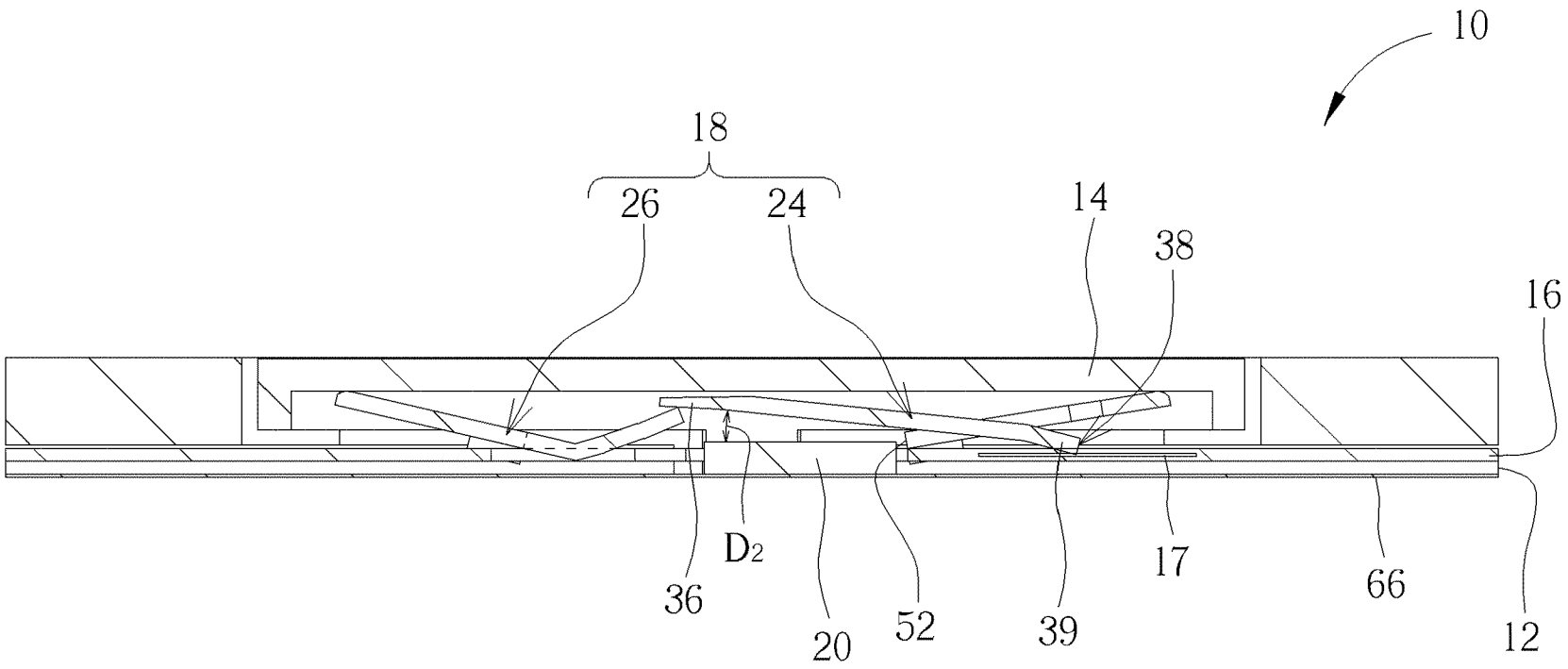
FIG. 6 is a cross-sectional diagram of the cap in FIG. 5 being pressed to the pressed position.
Figure 7:
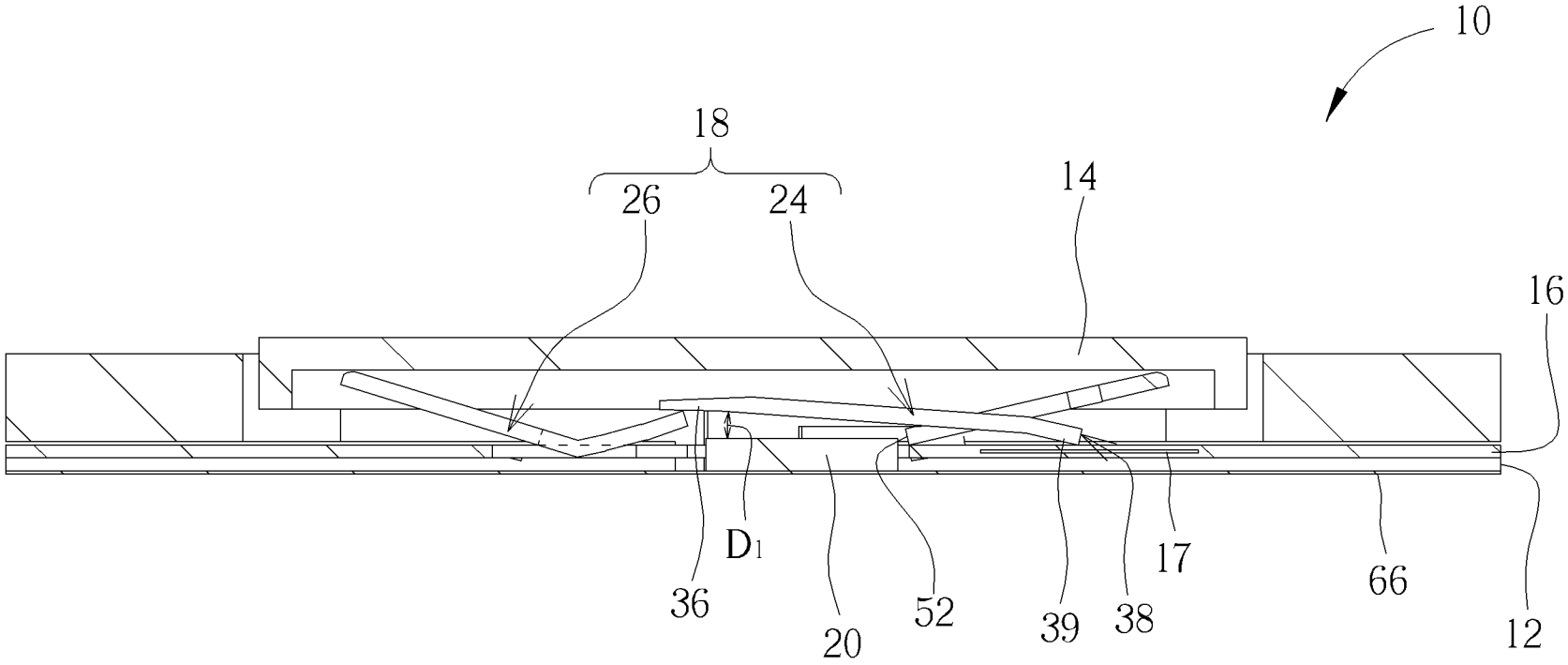
FIG. 7 is a cross-sectional diagram of an elastic cantilever arm in FIG. 5 triggering a switch.

More detailed description for the triggering operation and the cap returning operation of the keyswitch 10 is provided as follows. Please refer to FIG. 5, FIG. 6, and FIG. 7. FIG. 5 is a cross-sectional diagram of the keyswitch 10 in FIG. 1 along a cross-sectional line A-A when the cap 14 is assembled with the board 12. FIG. 6 is a cross-sectional diagram of the cap 14 in FIG. 5 being pressed to the pressed position. FIG. 7 is a cross-sectional diagram of the elastic cantilever arm 39 in FIG. 5 triggering the switch 16. When the cap 14 is not pressed, the magnetic attraction force between the second magnetic portion 36 and the first magnetic portion 20 could keep the cap 14 at the non-pressed position as shown in FIG. 5 for the user to perform an input operation.

When the cap 14 is pressed by an external force and the external force could overcome the magnetic attraction force between the first magnetic portion 20 and the second magnetic portion 36, the cap 14 presses the first support member 24 and the second support member 26 to make the second magnetic portion 36 separate from the first magnetic portion 20 and make the abutting portion 44 tilted. As shown in FIG. 6 and FIG. 7, the abutting portion 44 supports the second magnetic portion 36 in a point-to-surface contact manner, but not limited thereto. It means that the abutting portion 44 could support the second magnetic portion 36 in a surface-to-point contact manner in another embodiment (e.g. the second magnetic portion 36 could have a support end point extending downwardly to abut against an abutting surface of the abutting portion 44).

To be more specific, when the cap 14 presses the first support member 24 to take the edge portion 52 as a pivot shaft to rotate relative to the board 12, the first body 28 could rotate accordingly to make the elastic connection arm 50 drive the second body 30 to rotate by elastic deformation force of the elastic connection arm 50. During the aforesaid process, when the elastic connection arm 50 is not deformed to a predetermined amount of elastic deformation, the elastic deformation force of the elastic connection arm 50 is less than the rotation torque generated by the magnetic attraction force between the first magnetic portion 20 and the second magnetic portion 36, to keep the second magnetic portion 36 absorbed onto the first magnetic portion 20 (at this time, the elastic connection arm 50 has been deformed elastically, the second body 30 has not been completely rotated with the first body 28, and the elastic cantilever arm 39 has not triggered the switch unit 17 of the switch 16 yet).

When the elastic connection arm 50 is deformed to the predetermined amount of elastic deformation to make the elastic deformation force of the elastic connection arm 50 larger than the rotation torque generated by the magnetic attraction force between the first magnetic portion 20 and the second magnetic portion 36, the second body 30 of the first support member 24 could take the edge portion 52 as a pivot shaft to rotate relative to the board 12. At this time, with rotation of the second body 30 of the first support member 24, the magnetic attraction force between the first magnetic portion 20 and the second magnetic portion 36 is reduced rapidly as the distance between the second magnetic portion 36 and the first magnetic portion 20 is increased, so as to cause elastic deformation of the elastic connection arm 50 of the first support member 24 for accelerating rotation of the second body 30. Accordingly, the second magnetic portion 36 moves toward the cap 14, and the elastic cantilever arm 39 moves toward the board 12 with rotation of the first support member 24. During the aforesaid process, the edge portion 52 keeps rotatably connecting to the board 12 via the magnetic attraction force between the first magnetic portion 20 and the second magnetic portion 36, so as to make the first support member 24 surely abut against the board 12 without lifting.

Subsequently, when the second magnetic portion 36 of the second body 30 is separate from the first magnetic portion 20 at a specific distance $D_1$, as shown in FIG. 7, the elastic cantilever arm 39 of the second body 30 could trigger the switch unit 17 of the switch 16 for executing a corresponding input function. To be noted, as shown in FIG. 6, the user could continue pressing the cap 14 to the pressed position as shown in FIG. 6 (at this time, the second magnetic portion 36 is separate from the first magnetic portion 20 at a maximum distance $D_2$, meaning that the maximum distance $D_2$ is larger than the specific distance $D_1$), to keep the elastic cantilever arm 39 triggering the switch unit 17 of the switch 16 for generating stable electronic signals. In summary, the present invention could efficiently improve the triggering sensitivity of the keyswitch 10 via the aforesaid design that the elastic cantilever arm 39 could trigger the switch unit 17 of the switch 16 when the second magnetic portion 36 is separate from the first magnetic portion 20 at the specific distance $D_1$ (i.e. before the cap 14 is pressed to the pressed position as shown in FIG. 6 to make the cap 14 move downwardly a complete pressing stroke).

To be noted, even if the external force is exerted upon a side of the cap 14 close to the second support member 26 to cause uneven pressing force exerted upon the cap 14, the abutting portion 44 could still be tilted to upwardly push the first support member 24 with rotation of the second support member 26 via the design that the abutting portion 44 supports the second magnetic member 36, to ensure that the second magnetic portion 26 of the first body 30 could be separate from first magnetic portion 20. In such a manner, when the second magnetic portion 26 is separate from the first magnetic portion 20 at the specific distance $D_1$, the elastic cantilever arm 39 of the second body 30 could trigger the switch unit 17 of the switch 16 to execute a corresponding input function.

On the other hand, when the external force is released, the magnetic attraction force between the first magnetic portion 20 and the second magnetic portion 36 magnetically attracts the second magnetic portion 36 to approach the first magnetic portion 20 and then makes the second magnetic portion 36 absorbed onto the first magnetic portion 20, so as to drive the cap 14 to move from the pressed position as shown in FIG. 6 to the non-pressed position as shown in FIG. 5 for generating the automatic cap returning effect.

It should be mentioned that the present invention could only adopt the design that the first support member has the first limiting arm to be inserted between the two second bending sheets in an alternate arrangement with omitting the design that the triggering portion could trigger the switch when the second magnetic member is separate from the first magnetic member at the specific distance, or could omit disposal of the second support member, for simplifying the structural design of the keyswitch, and the related description could be reasoned by analogy according to the aforesaid embodiments and omitted herein. Furthermore, the cap returning design of the present invention is not limited to the aforesaid embodiments, meaning that the present invention could utilize other returning device for generating the returning force in another embodiment. For example, in another embodiment, the keyswitch could include the board, the cap, the switch, the support device, and a returning device. The returning device could preferably be a rubber dome or a spring (but not limited thereto) and could be disposed between the cap and the board. In such a manner, when the cap is not pressed, the returning device keeps the cap at the non-pressed position. When the cap is pressed by the external force, the triggering portion triggers the switch to execute a corresponding input function. When the external force is released, the returning force (i.e. the elastic force) provided by the returning force could drive the cap to move back to the non-pressed position with the support device, so as to generate the automatic cap returning effect. As for the related description for this embodiment and other derived embodiments (e.g. the support device could only have one single support member to be assembled with the board, the cap, the switch and the returning device), it could be reasoned by analogy according to the aforesaid embodiments and omitted herein.

In summary, since there is no scissor mechanism and elastic member disposed in the keyboard provided by the present invention, the present invention could greatly reduce the overall space occupied by the keyswitch, so as to be advantageous to the thinning design of the keyboard and effectively prolong the life of the keyswitch.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a board having a first magnetic portion and at least one pivot portion;

a cap;

a switch disposed between the board and the cap; and a support device disposed between the board and the cap, the support device comprising a first support member, the first support member having a first body and a second body, the first body having a first end portion and a second end portion, the first end portion being movably connected to the cap, the second end portion being movably connected to the at least one pivot portion, the second body having a triggering portion corresponding to the switch and a second magnetic portion corresponding to the first magnetic portion, a U-shaped slot being formed around the triggering portion to make the triggering portion form an elastic cantilever arm extending from the second body toward the board, the first body being integrally connected to the second body via an elastic connection arm;

wherein when the cap is not pressed, a magnetic attraction force between the first magnetic portion and the second magnetic portion keeps the cap at a non-pressed position; when the cap is pressed by an external force to make the second magnetic portion separate from the first magnetic portion at a specific distance, the elastic cantilever arm triggers the switch; when the external force is released, the magnetic force drives the second magnetic portion to approach the first magnetic portion, so as to make the cap move back to the non-pressed position with the support device.

2. The keyswitch of claim 1, wherein the support device further has a second support member, the second support member has a third end portion, a fourth end portion, and an abutting portion, the third end portion is movably connected to the cap, the fourth end portion is movably connected to the board, and the abutting portion is located under the second magnetic portion to support the second magnetic portion.

3. The keyswitch of claim 1, wherein at least one slot hole is formed between the first body and the second body for forming the elastic connection arm located between the slot hole and the U-shaped slot, and the elastic connection arm bridges the first body and the second body.

4. The keyswitch of claim 1, wherein the at least one pivot portion comprises two bending sheets arranged alternately with each other, and a limiting arm extends from the second end portion toward the two bending sheets to be inserted between the two bending sheets, to make the second end portion rotatably connected to the at least one pivot portion.

5. The keyswitch of claim 4, wherein at least one of the two bending sheets has a planar curved arm, and the planar curved arm extends along a planar direction of the board to be connected to the board.

6. The keyswitch of claim 5, wherein the planar curved arm is U-shaped.

7. The keyswitch of claim 1, wherein the first support member and the second support member are made of magnetic metal material.

8. The keyswitch of claim 1, wherein the board is made of magnetic metal material.

9. The keyswitch of claim 1 further comprising:

a magnetic plate disposed under the board.

10. The keyswitch of claim 1, wherein the specific distance is less than a maximum distance between the first magnetic member and the second magnetic member when the cap is pressed to a pressed position.

11. The keyswitch of claim 1, wherein the first body further has an edge portion, and the edge portion rotatably abuts against the board.

12. A keyswitch comprising:

a board having at least one pivot portion and a first magnetic portion, the at least one pivot portion having two bending sheets arranged alternately with each other;

a cap;

a switch disposed between the board and the cap; and a support device comprising a first support member and a second support member, the first support member having a first body and a second body, the first body having a first end portion and a second end portion, the second body having a second magnetic portion corresponding to the first magnetic portion and a triggering portion corresponding to the switch, the first end portion being movably connected to the cap, the second end portion having a limiting arm, the limiting arm extending toward the two bending sheets to be inserted between the two bending sheets to make the second end portion rotatably connected to the at least one pivot portion, a U-shaped slot being formed around the triggering portion to make the triggering portion form an elastic cantilever arm extending from the second body toward the board, the second support member having a third end portion, a fourth end portion and an abutting portion, the third end portion being movably connected to the cap, the fourth end portion being movably connected to the board, the abutting portion being located under the second magnetic portion to support the second magnetic portion;

wherein when the cap is not pressed, a magnetic attraction force between the first magnetic portion and the second magnetic portion keeps the cap at a non-pressed position; when the cap is pressed by an external force to make the second magnetic portion separate from the first magnetic portion, the triggering portion triggers the switch; when the external force is released, the magnetic force drives the second magnetic portion to approach the first magnetic portion, so as to make the cap move back to the non-pressed position with the support device.

13. The keyswitch of claim 12, wherein at least one of the two bending sheets has a planar curved arm, and the planar curved arm extends along a planar direction of the board to be connected to the board.

14. The keyswitch of claim 13, wherein the planar curved arm is U-shaped.

15. The keyswitch of claim 12, wherein at least one slot hole is formed between the first body and the second body for forming an elastic connection arm located between the slot hole and the U-shaped slot, and the elastic connection arm bridges the first body and the second body.

16. The keyswitch of claim 12, wherein the first support member and the second support member are made of magnetic metal material.

17. The keyswitch of claim 12, wherein the board is made of magnetic metal material.

18. A keyswitch comprising:

a board having a first pivot portion, the first pivot portion having two first bending sheets arranged alternately with each other, at least one of the two first bending sheets having a planar curved arm, the planar curved arm extending along a planar direction of the board to be connected to the board;

a cap;

a switch disposed between the board and the cap;

a support device comprising a first support member, the first support member having a first body and a second body, the first body having a first end portion and a second end portion, the second body having a triggering portion corresponding to the switch, the first end portion being movably connected to the cap, the second end portion having a first limiting arm, the first limiting arm extending toward the two first bending sheets to be inserted between the two first bending sheets to make the second end portion rotatably connected to the first pivot portion, a U-shaped slot being formed around the triggering portion to make the triggering portion form an elastic cantilever arm extending from the second body toward the board; and a returning device disposed between the cap and the board for driving the cap to move back to a non-pressed position;

wherein when the cap is not pressed, the returning device keeps the cap at a non-pressed position; when the cap is pressed by an external force, the triggering portion triggers the switch; when the external force is released, the returning device drives the cap to move back to the non-pressed position with the support device.

19. The keyswitch of claim 18, wherein the planar curved arm is U-shaped.

20. The keyswitch of claim 18, wherein the returning device is a magnetic attraction device.

21. The keyswitch of claim 18, wherein the returning device is a rubber dome or a spring.

22. The keyswitch of claim 18, wherein the board further has a second pivot portion, the second pivot portion has two second bending sheets arranged alternately with each other, the support device further comprises a second support member, the second support member has a third end portion and a fourth end portion, the third end portion is movably connected to the cap, the fourth end portion has a second limiting arm, and the second limiting arm extends toward the two second bending sheets to be inserted between the second bending sheets to make the fourth end portion rotatably connected to the second pivot portion.

* * * * *